United States Patent [19]

Taylor et al.

[11] Patent Number: 4,630,358

[45] Date of Patent: Dec. 23, 1986

[54] METHOD OF MAKING AN ELECTROSTATIC TRANSDUCER OF THE MOVING COIL TYPE

[75] Inventors: Frank Taylor, Bromley; Trevor Burton, Maidstone, both of England

[73] Assignee: Standard Telephones and Cables Public Limited Company, London, England

[21] Appl. No.: 641,563

[22] Filed: Aug. 16, 1984

[30] Foreign Application Priority Data

Aug. 16, 1983 [GB] United Kingdom ..... 8322052

[51] Int. Cl.[4] ..... H04R 31/00

[52] U.S. Cl. ..... 29/594; 29/742; 29/760; 29/785; 29/792

[58] Field of Search ..... 29/594, 602 A, 760, 29/742, 783–786, 791–794

[56] References Cited

U.S. PATENT DOCUMENTS

| | | | |
|---|---|---|---|
| 3,553,815 | 1/1971 | McElvy | 29/785 X |
| 4,173,824 | 11/1979 | Wolfthal | 29/783 |
| 4,566,178 | 1/1986 | Hecht et al. | 29/594 |

FOREIGN PATENT DOCUMENTS

| | | |
|---|---|---|
| 2322475 | 11/1974 | Fed. Rep. of Germany . |
| 7322439 | 1/1974 | France . |
| 360238 | 9/1973 | Sweden . |
| 2114855 | 8/1983 | United Kingdom . |
| 2134838 | 8/1984 | United Kingdom . |
| 2134746 | 8/1984 | United Kingdom . |

*Primary Examiner*—Carl E. Hall

*Attorney, Agent, or Firm*—Kerkam, Stowell, Kondracki, & Clarke

[57] ABSTRACT

A moving coil capsule for a telephone handset is designed for high speed mass production. It consists of a carrier ring (1) and diaphragm (2) formed as an interim sub-assembly in a first buffer store. A coil (6) preparation and finishing stage applies the coil (6) on a former in the form of an aluminium dome (5) and inserts the dome (5) into a nest (7) in the diaphragm to form a first sub-assembly in a second buffer store. A magnet assembly (10, 11 and 12) is manufactured using quick curing glue with the outer pole piece (12) formed by an accurate stamping whose outer rim fits precisely in a reference datum (1*a*) in the carrier ring.

The interim sub-assemblies and magnet assemblies are made one at a time, and the first sub-assemblies are formed two at a time from the interim sub-assemblies, but at half the speed.

Final assembly of the magnet assembly and first sub-assembly together with a rear cover (14) is carried out and a throughput at a rate of one capsule in less than four seconds can be achieved.

8 Claims, 5 Drawing Figures

METHOD OF MAKING AN ELECTROSTATIC TRANSDUCER OF THE MOVING COIL TYPE

BACKGROUND OF THE INVENTION

This invention relates to manufacturing a small electroacoustic transducer of the moving coil type.

An electroacoustic transducer such as a moving coil transducer for a telephone handset requires watchmaker-like precision to ensure that the coil is centrally located in the air gap of the magnet. The larger the number of turns in the coil and the smaller the air gap, the greater the sensitivity of the device and high sensitivity is a prime requirement. Fully automatic manufacture on the other hand demands tolerances in the device which are difficult to minimise and at the same time maintain an acceptable manufacturing cost level at which the device will be competitive against existing similar devices such as other moving coil devices or the well known rocking-armature transducer. The moving coil transducer is favoured for its low distortion.

It is an object of the present invention to devise a process and apparatus for manufacturing a small electroacoustic transducer of the moving coil type which provides a cheap yet sensitive product and lends itself to fully automatic operation.

SUMMARY OF THE INVENTION

According to one aspect of the present invention there is provided an apparatus for making an electroacoustic transducer comprising:

a diaphragm forming rotary turret indexing machine having a number of similar workpiece jigs each adapted to support a moulded plastics support ring against a reference datum on the ring and index the ring through a number of diaphragm forming stations to form and secure a diaphragm to the ring to produce an interim sub-assembly;

a coil applying rotary turret indexing machine having a number of similar workpiece support pallets each adapted to support two of the sub-assemblies and index them together through a number of work stations to secure a speech coil to the diaphragm of each sub-assembly, to produce a first sub-assembly;

and an assembly machine for assembling together the first sub-assembly with a magnet assembly and a rear cover.

According to another aspect of the present invention there is provided an apparatus for making an electroacoustic transducer comprising:

a diaphragm forming rotary turret indexing machine which has a number of similar workpiece support jigs for supporting a moulded plastics support ring against a reference datum on the ring and which indexes the ring through a number of diaphragm forming stations to form and secure a diaphragm to the ring to produce an interim sub-assembly;

a coil applying rotary turret indexing machine having a first station at which the interim sub-assembly is mounted coaxially with a diaphragm dome carrying a speech coil, and a second station at which the dome and interim sub-assembly from the first station are moved toward each other to assemble them together.

According to a further aspect of the present invention there is provided an apparatus for making an electroacoustic transducer comprising:

a diaphragm forming rotary turret indexing machine which has a number of similar workpiece support jigs adapted to support a moulded plastics support ring and index the ring through a number of stations to attach to the ring a diaphragm to produce an interim sub-assembly;

a coil applying rotary turret indexing machine which has a number of similar workpiece support jigs adapted to support the first sub-assembly coaxial with a speech coil and attach the speech coil to the sub-assembly, to produce a first sub-assembly;

a cover applying rotary turret indexing machine having a number of similar workpiece support jigs adapted to support a metallic front cover and the first sub-assembly coaxial with one another, and move them through a fixing station where the cover becomes fixed to the first sub-assembly;

and an assembly machine for assembling together the first sub-assembly having the front cover with a magnet assembly.

According to yet another aspect of the present invention there is provided equipment for making an electroacoustic transducer comprising:

a first apparatus for producing a first sub-assembly comprising a moulded plastics support ring carrying a diaphragm with a speech coil secured to the diaphragm;

a second apparatus arranged to support a magnet assembly having an annular air gap with the sub-assembly carried loosely thereon and to vibrate the magnet and sub-assembly relative to each other to ensure the speech coil falls into the air gap, and a third apparatus for applying a rear cover to secure the magnet in the sub-assembly.

According to yet a further aspect of the present invention there is provided a method of making an electroacoustic transducer capsule of the moving coil type comprising:

providing a first buffer store with a plurality of first sub-assemblies each comprising a moulded plastics carrier ring with a diaphragm secured thereto and a speech coil secured to the diaphragm concentric with a circular locating reference datum in the ring;

providing a second buffer store with a plurality of magnet assemblies each having a circular locating rim and an annular air gap in which the speech coil will be positioned;

providing a third store with a plurality of closure members for closing the rear of the transducer, and feeding the first sub-assemblies, the magnet assemblies and the closure members automatically to an assembly machine which first locates the rim of the magnet assembly against the reference datum with the speech coil positioned in the air gap and then secures the closure member onto the rear of the carrier ring to close the capsule and hold the magnet assembly against the reference datum.

According to another aspect of the invention there is provided a method of making an electroacoustic transducer capsule of the moving coil type comprising:

feeding a first buffer store with a plurality of interim sub-assemblies at a first rate each comprising a moulded plastics carrier ring with a diaphragm secured thereto;

feeding the interim sub-assemblies at the same rate from the first buffer store to receive wound speech coils secured thereto to produce a first sub-assembly and collecting the first sub-assemblies in a second buffer store;

feeding a third buffer store with magnet assemblies at said rate, each having an annular air gap to receive the speech coil and designed to fit precisely in the carrier ring; and feeding to an automatic assembly machine the first sub-assemblies, the magnet assemblies and a closure member each at said rate to assemble and secure them together to form the capsule.

BRIEF DESCRIPTION OF THE DRAWINGS

In order that the invention can be clearly understood reference will now be made to the accompanying drawings, in which.

DESCRIPTION OF PREFERRED EMBODIMENTS

Figure 1:
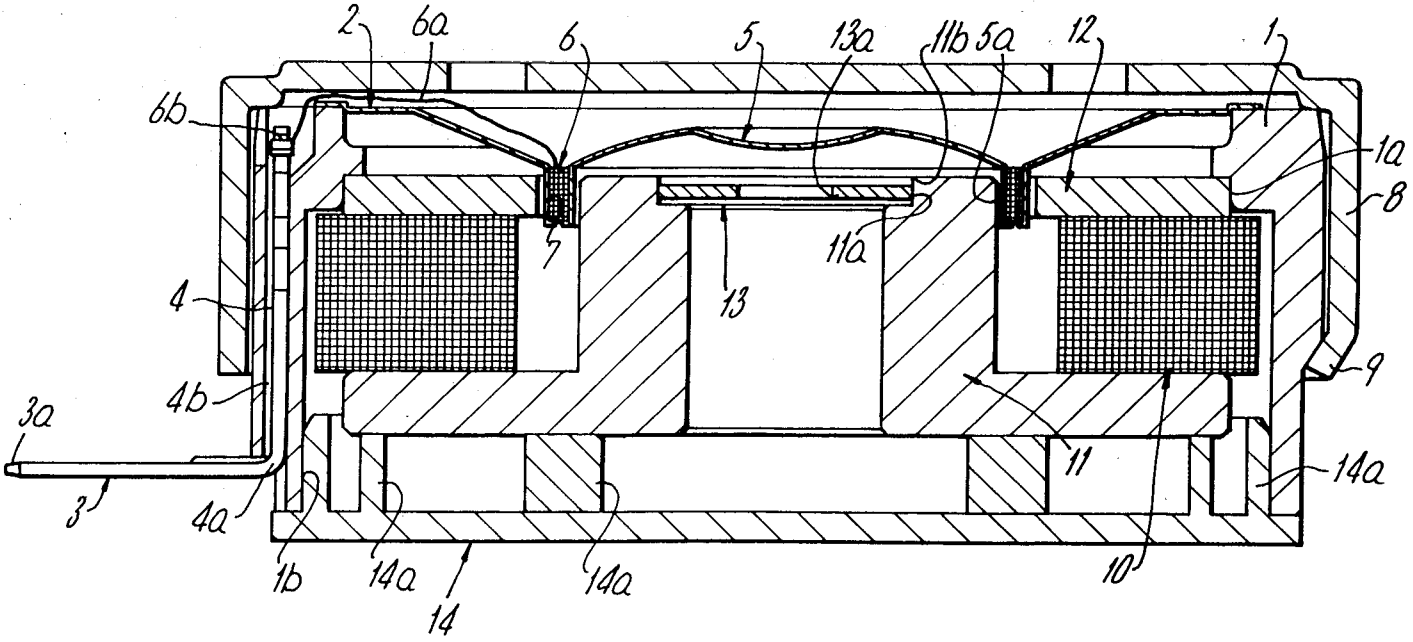
FIG. 1 shows a cross section of a novel moving coil transducer capsule for a telephone made by a method and apparatus according to an embodiment of the present invention.

The manufacture of the moving coil transducer shown in FIG. 1 is carried out in four basic stages. Stage 1 (FIG. 2) includes a moulded plastic support ring 1 and a diaphragm 2 welded at its outer periphery to the support ring 1. Aspects of this part of the manufacture are covered in detail in our published GB Patent Application Nos. 2114855A and 2134838A. Connection terminals 3 are fitted in slots 4 but are unbent 4*a* at this stage. This component is held in a buffer store A, shown in FIG. 2. Stage 2 (FIG. 3) takes the component from buffer store A, fabricates an aluminium dome 5 and winds a coil 6 on in and assembles the dome 5 with coil 6 into a nest or central aperture 7 of the diaphragm 2 and secures the coil 6 in the aperture. Aspects of this part of the manufacture are covered in detail in our published GB Patent Application No. 2134746A. The ends 6*a* of the coil are welded to the connection terminals at 6*b*. An aluminium front cover 8 is fitted over the front of the support ring 1 and swaged to it at 9.

This component is held in a second buffer store B.

Figure 4:
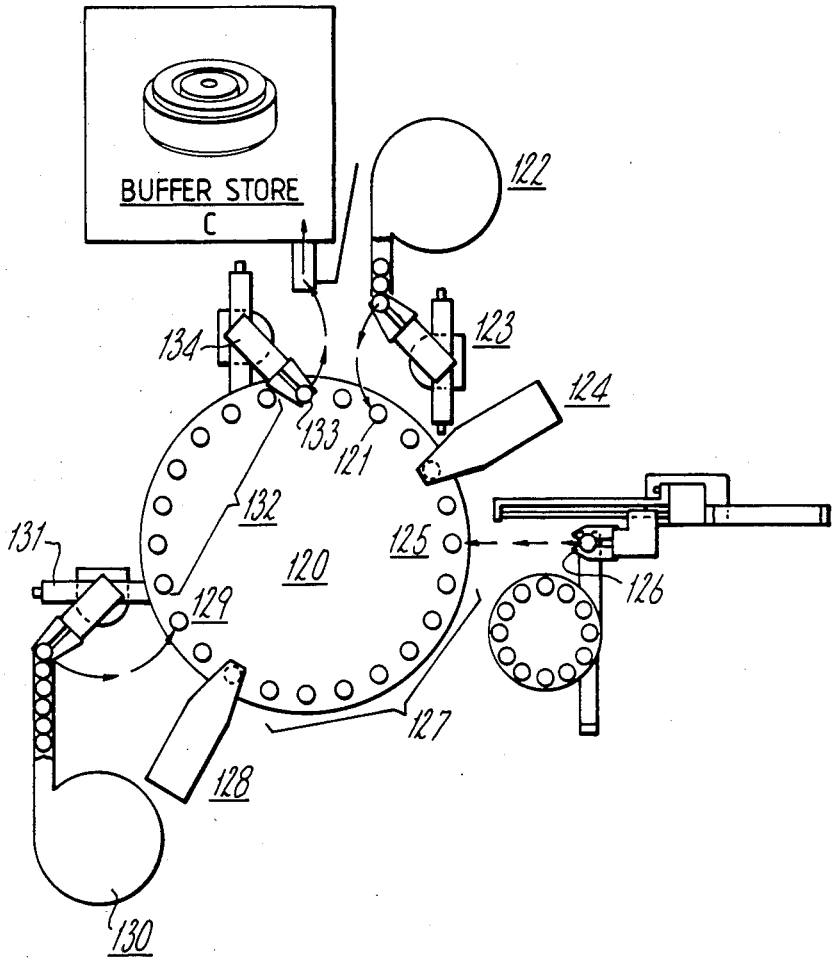
FIG. 4 shows a rotary turret indexing machine for producing a magnet and pole piece assembly for the transducer of FIG. 1.

The third stage (FIG. 4) is carried out at the same time as stages A and B and assembles together a magnet 10, an inner pole piece 11 and an outer pole piece 12, and feeds the assembly to a third buffer store C.

The fourth and final stage (FIG. 5) takes the components of buffer stores B and C, fits an acoustic damper plug 13 to the magnet assembly, and assembles the two components together, bends the terminals 3 and secures the components together with a rear cover 14. Aspects of this part of the manufacture are covered in more detail in our published GB Patent Application No. 2134847A. It also tests the finished transducer.

Figure 2:
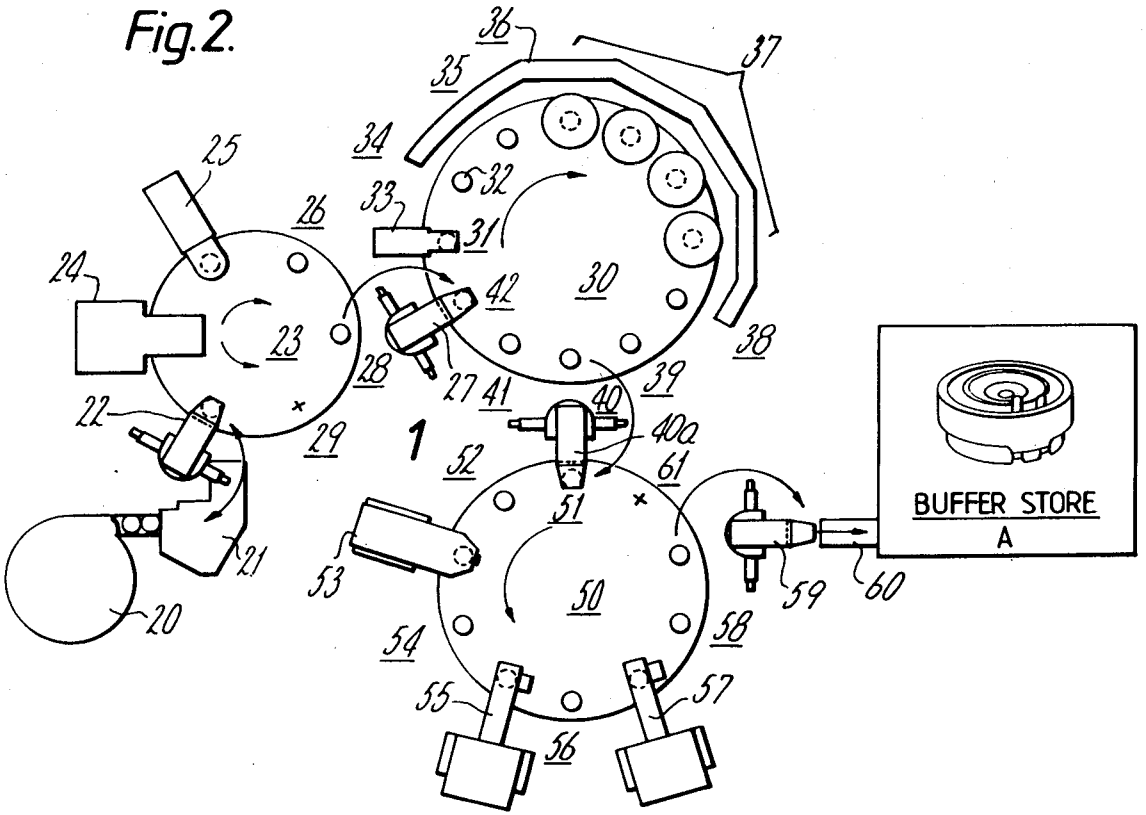
FIG. 2 shows three rotary turret indexing machines which produce a support ring and diaphragm component for the moving coil transducer of FIG. 1.
Figure 3:
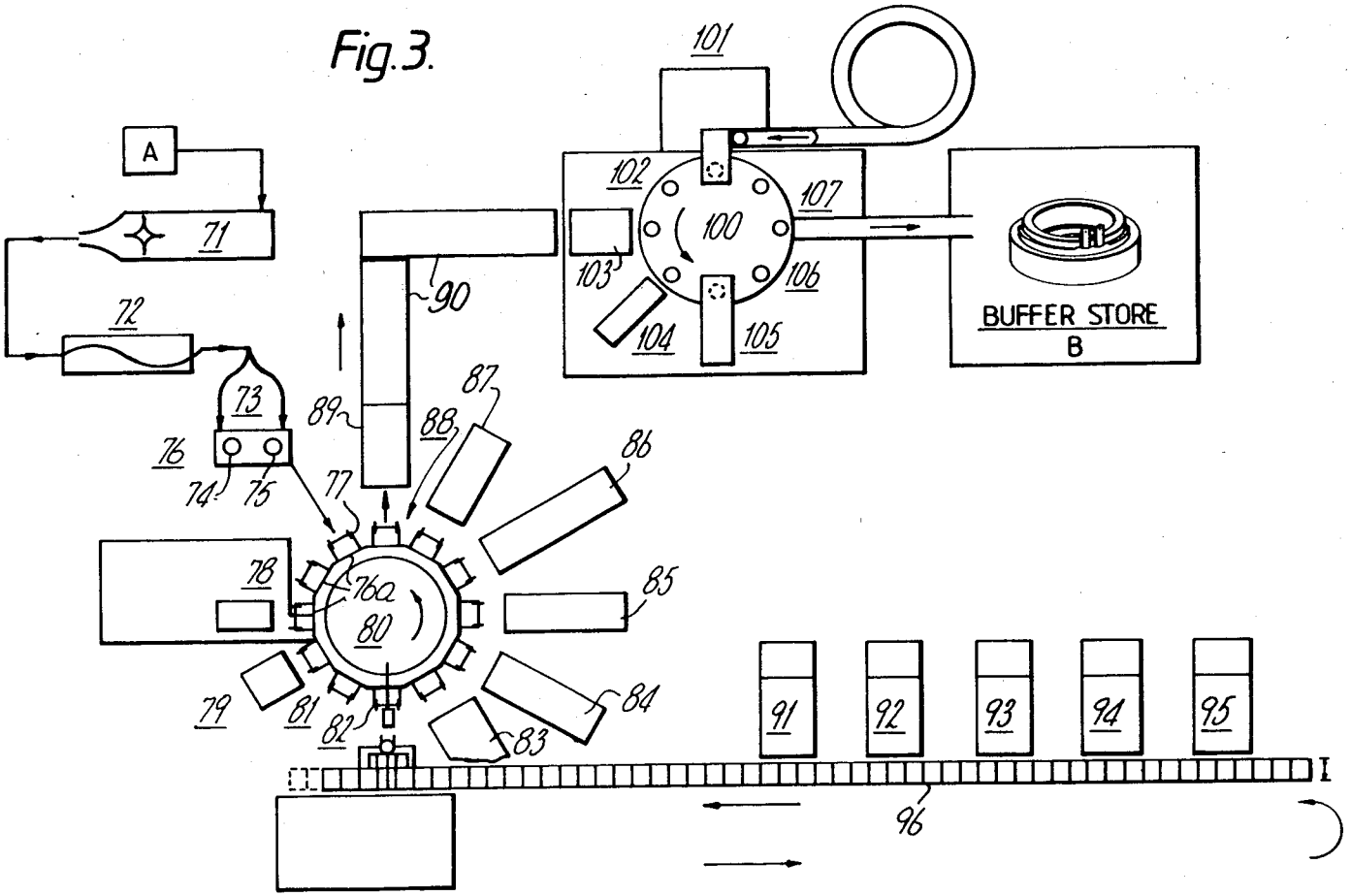
FIG. 3 shows two rotary turret machines, a walking beam pallet transfer machine and coil winding heads for coil winding, assembling the coil to the diaphragm, welding the coil terminations to the terminals and assembling the front cover.

Referring to FIG. 2 of the drawings a vibrating bowl feeder 20 feeds the carrier support ring into a linear feeder 21 which controls the back pressure so as to provide a continuous supply feeding into a dead zone and maintains a constant level in the line feeder 21. A pick-up-and-place unit 22 places the ring 1 onto the rotary turret indexing machine 23 which has six jigs. Each jig is the same and consists of an upstanding tubular support which fits the reference datum 1*a*. At the first station a head 24 blanks out a polycarbonate disc for the diaphragm 2 which is retained at the end of a punch using a vacuum. The disc is transferred down onto the top of the support ring 1. The vacuum is released and the punch returns leaving the disc in situ on top of the support ring 1. The machine then indexes and takes the support ring 1 underneath a heat sealing head 25 while a vacuum in the jig is kept on so that there is no possibility of the disc moving. The heat sealing head 25 comes down and welds the polycarbonate disc onto the rim of the polycarbonate support ring 1 and then withdraws and then the vacuum is released.

The component then passes on to the next station 26 where the presence of the component comprising the diaphragm and the support ring 1 is checked. If the component is present then on the next index the component is transferred at station 28 by a second pick-up-and-place unit 27 into the first station 31 of a second rotary turret indexing machine 30. Station 29 checks the absence of a component. If any of the sensors have failed to detect, the jaws of the pick-up-and-place unit 27 opens midway during the transfer in order to discard an "absent" or incomplete component.

The component is loaded in machine 30 onto a blow forming mould jig inside a pressure chamber, the lid of which is open at this stage. The second turret machine 30 has twelve heads, each with a pressure chamber with a lifting lid, the lifting lid having a glass window in the top surface for infra-red heating of the diaphragm when the lid is closed. The components placed in by the pick-up-and-place unit 27 seat over the locating and moulding jig such as 32 within the pressure chamber and locates the support ring on the reference datum 1*a*.

At the second station 33 the support ring is pressed down to ensure that the reference datum 1*a* engages the jig. At the third and fourth stations 34 and 35, the lid is closed by an external carry rail 36. At the fourth station 35 closure is complete and the fifth station is the first of the four infra-red lamps 37 each of which produces a diffused heated area over the diameter of the polycarbonate disc. Heating takes place under the four lamps. As the box indexes out from the fourth lamp the air pressure comes on. The air pressure is retained on through the next station 38 to form the diaphragm, and is kept on. Just before indexing from station 38 to 39 the air pressure is released and the lid begins to open. At station 40 the lid is fully open, and a pick-up-and-place mechanism 40*a* approaches, lifts the component out of the jig fixture and places it into the first station of a third rotary turret indexing machine 50. At station 41 the surface temperature of the mould is measured with a non-contact thermometer to see whether the temperature of the mould is approaching the upper limit of an acceptable range. If it is approaching the upper temperature then the surface of the mould is cooled by means of an external air jet. The temperature range at station 42 is indicative of the correct temperature for the production of a good diaphragm on the next circuit of the machine.

The third rotary indexing machine 50 has ten heads. The orientation of the support ring 1 was determined at the first station 22 on the first rotary turret machine and is maintained throughout and is specifically determined for the operations to be carried out on the third rotary turret machine. At the first station 51 of the third machine the pick-up-and-place mechanism 40*a* unloads, places the component onto the acceptance nest which again engages the datum 1*a*. The second station 52 senses the presence of the component and ensures it is loaded properly. The next station 53 is a zero clearance punch and die which is designed for interchangeable tooling. This takes out the bottom of the nest or aperture shown at 7 in FIG. 1. At the next station 54 the presence of a hole in the bottom of the diaphragm is checked and at the next station 55 the first of the two terminals is inserted, cropped from a bandolier strip and inserted into the terminal slot 4*b* shown in FIG. 1. The terminal is only partially inserted so that the front end of the terminal 3*a* is flush with the bottom of the carrier ring 1, which leaves the other end of the terminal (where the weld 6*b* is shown) standing proud ready for the coil winding operation. The next station 56 is used to sense the presence of that terminal. The next station 57 puts the second terminal in the other terminal slot (not visible in FIG. 1 but adjacent the slot 4*b*), cropping the terminal from a second bandolier strip. Station 58 checks the presence of the second terminal. At the next station a pick-up-and-place mechanism 59 transfers the component as a first sub-assembly from the jig to a link conveyer 60 to the first buffer store A. Any failure to recognise a component at any of the sensing heads will release the jaws of the pick-up-and-place mechanism during transfer. Station 61 checks for an empty jig.

The output from the buffer store is via a ferris wheel mechanism 71 to orientate the first such sub-assemblies single file with the terminals trailing, and from here a linear vibratory feeder 72 turns the component over 180°, and introduces the components in a vertical plane in a pair of side by side chutes 73. From here the components are loaded on the coil winding spindles 74 and 75 of a two-spindle-pallet 76 for the coil winding operation.

The next machine 80 comprises a twelve station rotary turret indexing machine and forms from the first sub-assembly the preparation module and finishing module for a coil winding machine. The coil winding machine comprises five coil winding heads 91 to 95 each coil winding head accepting a twin spindle pallet 76 mounted on it. Each twin spindle pallet 76 is marshalled to the winding head by a walking beam 96, which operates so that any coil winding head available for coil winding (i.e. not occupied) accepts the pallet. Thus the walking beam feeds pallets into and takes pallets from station 82 of the twelve turret machine 80 and the walking beam and the coil winding heads form a closed loop extension of station 82. The wound pallets are fed back into station 82 for the finishing of the coils through stations 83 to 88.

The walking beam and machine 80 operate on a cycle twice as long as the machines 23, 30 and 50 so as to maintain a constant cycle throughput time per transducer.

Each turret has a clamping face 76*a* against which the pallets 76 are clamped. So each pallet 76 travels around every station of the machine 80 and along the walking beam 96 to and from the coil winding heads via station 82. At the first station 77 two support rings 1 with formed diaphragm 2 and terminals 4 are loaded on. At the second station the presence of the two components is checked and at the third station 78 the domes 5 forming the second part of the two-part diaphragm are produced and punched from reels of thin lightweight strip metal. These domes are loaded onto twin arbors 74, 75 of the coil winding pallets 76. An outer collet on each arbor is withdrawn so that the arbor expands to hold the dome 5. At station 79 the presence of the components is checked. If this is correct a "memory" pin is reset. This enables the coil winding heads to recognise that the pallet contains components ready for winding. The next station 81 is blank and station 82 offers the pallet 76 to the walking beam 96 as discussed earlier. It also accepts a pallet 76 with a pair of wound domes 5,6 from the walking beam 96 for indexing to station 83, where the connection terminals 3 are pushed in approximately 1 mm to slacken the coil ends 6*a* extending between the terminals 3 and the coil 6. The components are then indexed to station 84, and here the domes 5 with wound coils 6 are pushed into the aperture 7 of the outer diaphragm part 2 and at the same time the terminals 3 are further inserted into their slots. The collet sleeves are brought forward to release the domes 5 from the collets so that the coils are an interference fit in the aperture 7 in the outer diaphragm part 2. The terminals 4 are then pressed further into their slots at the next station 85 to become almost flush with the front face of the diaphragm. The machine indexes to station 86.

Here a pivotally mounted capacitor discharge welding head welds both coil ends to the connection terminals for one of the components by rocking about its pivot from the first to the second terminal 4.

At station 87 the second component terminals 4 are welded by a similar capacitor discharge welding head which is also pivotally mounted and rocks from the first to the second terminal. The machine then indexes and at station 88 the components are removed and are fed by a sliding shuttle 89 through a solvent applying station 90 where solvent is dripped onto the coils 6 in order to soften the outer layer of enamel on the coil 6 and amalgamate the coil turns into a unitary bonded coil. They proceed through a curing region of station 90 and are applied to another rotary indexing machine 100 which has eight stations. This machine fits the front cover 8 to the carrier ring 1.

At the first station 101 a bowl feeder 102 containing aluminium front covers 8 feeds the covers 8 to the machine and the covers are placed upside down on the first station in a hollow jig by a pick-up-and-place mechanism at station 101. The machine indexes to station 102 and the presence of the cover is checked. At station 103 the support ring with complete diaphragm and coil is turned upside down and placed inside the front cover, and at station 104 a low pressure test is applied to check the acoustic resistance of slots around the circumference of the diaphragm. The machine indexes to station 105 at which the front cover 8 is swaged at 9 around the support ring 1. At station 107 the component is unloaded and fed to a buffer store B.

The next rotary turret machine 120 manufactures the magnet assembly. Each station of this machine, which has twentyfour stations, comprises a tubular jig which is capable of being rotated from beneath the table of the machine and which is just smaller than the air gap of the finished assembly. At the first station 121 the outer pole piece 12 of the magnet assembly, which is an accurate stamping, is fed from a vibratory bowl feeder 122 over the tubular jig by a pick-up-and-place mechanism 123. The next station checks the presence of the outer pole piece 12, and at the next station 124 a thin bead of liquid adhesive is applied to the exposed upper surface of the outer pole piece 12 while the tubular jig is rotated so that a ring of adhesive is created. This adhesive is similar to widely available "super-glue" made by Loctite. The quantity of adhesive is closely metered. This adhesive is a cyano-acrilate adhesive.

The next station is blank, and the station after that 125 receives the annular magnet 10. The annular magnets 10 are automatically washed before assembly to minimise dust formation on the surface, and they are at this stage unmagnetised. The magnet 10 is applied to the top surface of the outer pole piece 12 with a pair of jaws 126 and a clamp adjacent to the tubular jig presses the magnet down onto the upper surface of the pole piece. The clamp stays on for a further seven stations 127 during which time the glue cures and hardens. It is then released.

At the next station 128 a second circular bead of adhesive is applied to the upper surface of the magnet while the jig is rotated again. The next station is blank, and at the next station 129 a bowl feeder 130 feeds the inner pole piece 11 to a pick-up-and-place mechanism 131 which transfers the inner pole piece 11 to a position just above the magnet 10. The inner pole piece locates on the inside of the tubular jig and the clamp then presses the inner pole piece 11 down onto the surface of the magnet 10. The next seven stations 132 are used for curing and hardening the second feed of adhesive and, after the clamp is released, at the final station 133 the completed magnet assembly is unloaded from the tubular jig by a pick-up-and-place mechanism 134 and turned over and fed to a buffer store C.

Figure 5:
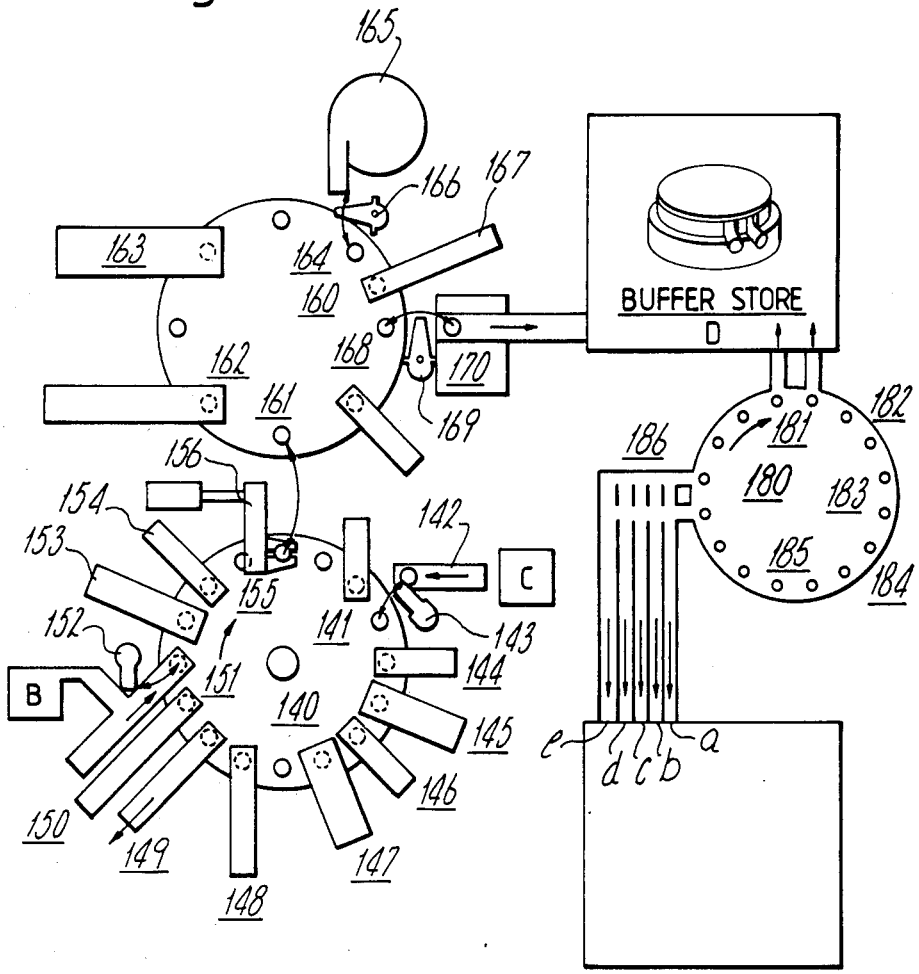
FIG. 5 shows three rotary turret indexing machines for assembling together the components of FIG. 3 and FIG. 4 and a rear cover, magnetising the magnet and final testing of the completed transducer shown in FIG. 1.

The final stage of manufacture is accomplished by the fourth unit (FIG. 5). A rotary turret indexing machine 140 receives the carrier ring 1 complete with front cover 8 and diaphragm assembly from store B, the magnet assembly from store C and a rear cover 14. These are assembled together to form the completed moving coil capsule. At station one (141) the magnet assembly is fed via a conveyor 142 from store C and a pick-up-and-place mechanism 143. At the next station 144 the presence of the magnet assembly is checked. At the next station 145 the acoustic damper plug 13 is manufactured by punching from a continuous strip. The circular damper plug has a central aperture 13*a* of a size to produce the acoustic resistance required. This plug is applied to a central recess 11*a* in the central pole piece 11 of the magnet assembly. At the next station 146 the presence of the plug is checked and at the next station 147 the damper plug 13 is staked by swaging over the edge wall 11*b* of the central recess 11*a*. This is done by orbital rivetting and is disclosed more fully in our published GB Patent Application No. 2114855A. At the next station 148 a pressure test is made to test the air flow through the damper plug 13 in comparison with a test plug. Station 149 is a reject stage should the test on the plug be unsatisfactory. At station 150 a location pin within the jig is pushed down and at the next station 151 the carrier ring from store B is loaded on top of the magnet assembly and released by a loading pick-up-and-place mechanism 152. Care is taken at this stage to ensure that the coil 6 is not damaged on the magnet assembly.

In order to accurately locate the carrier ring on the magnet assembly the next station 153 on the machine oscillates the carrier ring 1 to ensure that the coil 6 gently enters the air gap 5*a* in the magnet assembly as the carrier ring falls under gravity and the outer pole piece 12 accurately locates in the circular reference datum 1*a* in the carrier ring 1.

The next station 154 checks the electrical continuity of coil 6 to ensure that it has not been damaged in the preceeding stages. The assembled magnet assembly and carrier ring are then offloaded from the next station 155 on the machine and turned upside down and placed in the first station 161 of the final rotary indexing machine 160 by a reversing pick-up-and-place mechanism 156.

At the next station 162 on this machine the assembly is oriented to ensure a correct predetermined orientation of the terminals. The next station is blank and at station 163 the terminals are bent outwardly as shown at 4*a* in FIG. 1 so that they project radially from the assembly. The next station is blank and at station 164 the polycarbonate rear cover 14 with projecting hollow spiggots 14*a* is loaded on top of the carrier ring and magnet assembly by a pick-up-and-place mechanism 166. This cover is fed from a vibratory bowl feeder 165. At the next station 167 the rear cover 14 is pressed down and the spiggots 14*a* are an interference fit against the tapered inside surface 1*b* of the carrier ring 1.

The ends of the spiggots 14*a* bear against the face 11*b* of the inner pole piece so that at this stage the rear cover 14 is not fully inserted although the interference fit keeps it in place.

At the final station 168 the assembly is unloaded by pick-up-and-place mechanism 169 and placed in an ultrasonic welding station 170. This ultrasonically presses and welds the rear cover 14 to the inner pole piece 11 of the magnet assembly and to the carrier ring surface 1*b*. The six spiggots 14*a* collapse during the ultrasonic welding and produce the final peripheral weld to the carrier ring 1. The completed component then passes into buffer store D.

The completed capsule then requires magnetising and testing and this is done on a final rotary indexing machine 180. The machine 180 comprises of an eight position rotary indexing table around which are positioned the operating stations. Each position has two nests to carry a pair of capsules and the operations are as follows:

At station 181 two capsules from store D are loaded into two nests in the rotary table. The capsules are loaded front cover uppermost and orientated to ensure that electrical contact can be made with the terminals 3.

At station 182 one of the pair of capsules is raised from its nest in the table and sealed against the underside of an acoustic chamber which is mounted within the core of a magnetisation coil.

The coil is then energised and this magnetises the magnet to saturation level. The capsule is driven by a white noise source and an electronic circuit compares the output of the microphone to a preset value and, if excessive, applies an oscillatory demagnetising current to the coil. This process continues until the preset value is reached. The capsule is then returned to its nest in the table.

At station 183 the same process is applied to the other capsule of the pair.

At station 184 the D.C. resistance of both coils are measured and compared with preset limit values. The result of this test is recorded in memory for execution at station 186.

At station 185 two artificial ears are mounted directly above the location nests in the rotary table. The pair of capsules are raised out of the nests in the table and clamped against seals of the ears.

Testing then takes place using a spectrum analyser.

The next station is idle.

At the final station 186 the capsules are removed from the rotary table and placed in the respective outlet channel relative to the test data stored in the memory:

Channel a—Pass all tests,

Channel b—Sensitivity in low band,

Channel c—Sensitivity in high band,

Channel d—Fail sensitivity only,

Channel e—Rejects.

The transducer described has a diameter of just over three centimeters.

It is to be understood that the term "diaphragm" used in the description and throughout the claims means not only a sound producing diaphragm but also one which in a modification presently envisaged acts mainly if not wholly as a centering device for a larger separate speech cone to be driven by the capsule. In this modification the diaphragm is preferably slotted to allow greater axial movement and it is envisaged that the head 24 which blanks out the polycarbonate disc on machine 23 also blanks out the slots. In this modification the front cover 8 would not be required.

We claim:

1. A method of making an electroacoustic transducer capsule of the moving coil type comprising:

providing a first buffer store with a plurality of first sub-assemblies each comprising a moulded plastics carrier ring with a diaphragm secured thereto and a speech coil secured to the diaphragm concentric with a circular locating reference datum in the ring;

providing a second buffer store with a plurality of magnet assemblies each having a circular locating rim and an annular air gap in which the speech coil will be positioned;

providing a third store with a plurality of closure members for closing the rear of the transducer, and feeding the first sub-assemblies, the magnet assemblies and the closure members automatically to an assembly machine which first locates the rim of the magnet assembly against the reference datum with the speech coil positioned in the air gap and then secures the closure member onto the rear of the carrier ring to close the capsule and hold the magnet assembly against the reference datum.

2. A method as claimed in claim 1, wherein the magnet assembly is first positioned with the air gap facing upwards, the carrier ring is positioned and located on the magnet assembly, and the two are then turned upside down and the closure member is then applied and secured.

3. A method as claimed in claim 1, wherein the first sub-assembly is manufactured as part of the method, wherein the carrier ring is stored in a fourth store and fed to a first manufacturing unit including a rotary indexing machine, which carries the carrier ring through a first station which applies and secures a flat diaphragm to the ring and a plurality of further stations which shape the diaphragm by the application of heat and pressure and form a speech coil locating rim concentric with the circular reference datum.

4. A method as claimed in claim 1, wherein the first sub-assembly is manufactured as part of the method, wherein the carrier ring and diaphragm are stored in a fifth buffer store and fed from there to a coil applying rotary indexing machine which carries the carrier ring and diaphragm through a plurality of stations which applies to the diaphragm a wound speech coil and secures it to the diaphragn concentric with the reference datum.

5. A method as claimed in claim 4, wherein one of the stations of the coil applying machine is coupled with a coil winding machine via a walking beam which transfers the carrier ring and diaphragm to and from the coil winding machine.

6. A method as claimed in claim 1, wherein the magnet assembly is manufactured as part of the method and comprises an annular ring forming the outer pole piece, a tubular inner pole piece projecting from a backplate, and an annular magnet sandwiched between the outer pole piece and the backplate of the inner pole piece, wherein the inner and outer pole pieces and the magnets are fed to a rotary indexing magnet assembling machine having a number of tubular nests, wherein the outer pole piece is located on the nest at a first station, the magnet is assembled onto the outer pole piece at a subsequent station and the inner pole piece is assembled onto the magnet by locating the tubular inner pole piece inside the nest at a further subsequent station, wherein glue is applied to secure the three parts together.

7. A method as claimed in claim 6, wherein the tubular nests are rotated at glue-applying stations of the magnet assembling machine, whereby to provide a ring of glue concentric with the air gap at the interfaces between the magnet and the inner and outer pole pieces respectively.

8. A method as claimed in claim 2, wherein the first sub-assembly is manufactured as part of the method, wherein the carrier ring is stored in a fourth store and fed to a first manufacturing unit including a rotary indexing machine, which carries the carrier ring through a first station which applies and secures a flat diaphragm to the ring and a plurality of further stations which shape the diaphragm by the application of heat and pressure and form a speech coil locating rim concentric with the circular reference datum.

* * * * *